US010443422B2

(12) United States Patent
Ratzlaff et al.

(10) Patent No.: US 10,443,422 B2
(45) Date of Patent: Oct. 15, 2019

(54) GAS TURBINE ENGINE WITH A RIM SEAL BETWEEN THE ROTOR AND STATOR

(71) Applicant: General Electric Company, Schenectady, NY (US)

(72) Inventors: Jonathan Russell Ratzlaff, Loveland, OH (US); Michael Thomas Hogan, Tewksbury, MA (US); Julius John Montgomery, Mason, OH (US)

(73) Assignee: General Electric Company, Schenectady, NY (US)

( * ) Notice: Subject to any disclaimer, the term of this patent is extended or adjusted under 35 U.S.C. 154(b) by 275 days.

(21) Appl. No.: 15/040,603

(22) Filed: Feb. 10, 2016

(65) Prior Publication Data

US 2017/0226884 A1 Aug. 10, 2017

(51) Int. Cl.

| | |
|---|---|
| ***F01D 11/04*** | (2006.01) |
| ***F01D 5/02*** | (2006.01) |
| ***F01D 9/04*** | (2006.01) |
| ***F01D 11/00*** | (2006.01) |

(52) U.S. Cl.

CPC ..... *F01D 11/04* (2013.01); *F01D 5/02* (2013.01); *F01D 9/04* (2013.01); *F01D 11/001* (2013.01); *F05D 2220/32* (2013.01)

(58) Field of Classification Search

CPC ..... F01D 11/001; F01D 11/02

See application file for complete search history.

(56) References Cited

U.S. PATENT DOCUMENTS

| | | | | |
|---|---|---|---|---|
| 4,218,189 | A | 8/1980 | Pask | |
| 5,222,742 | A * | 6/1993 | Roberts | F01D 11/02 277/420 |
| 6,506,016 | B1 | 1/2003 | Wang | |
| 6,779,972 | B2 | 8/2004 | Farrell et al. | |
| 8,834,122 | B2 | 9/2014 | Ingram | |
| 8,864,452 | B2 | 10/2014 | Tham et al. | |
| 8,926,283 | B2 | 1/2015 | Lee et al. | |
| 8,979,481 | B2 | 3/2015 | Ingram | |
| 2006/0275106 | A1 * | 12/2006 | Alvanos | F01D 5/082 415/110 |
| 2006/0275108 | A1 | 12/2006 | Memmen et al. | |
| 2008/0145208 | A1 | 6/2008 | Klasing et al. | |

(Continued)

FOREIGN PATENT DOCUMENTS

| | | | |
|---|---|---|---|
| CN | 104632292 | A | 5/2015 |
| EP | 1 731 717 | A2 | 12/2006 |
| EP | 1 731 718 | A2 | 12/2006 |

OTHER PUBLICATIONS

Extended European Search Report and Opinion issued in connection with corresponding EP Application No. 7154886.0 dated Jun. 22, 2017.

(Continued)

*Primary Examiner* — Justin D Seabe

(74) *Attorney, Agent, or Firm* — McGarry Bair PC

(57) ABSTRACT

An apparatus relating to a rim seal for gas turbine engine comprising a wing extending into a buffer cavity with at least one set of protuberances including a first protuberance extending into the buffer cavity and a second protuberance extending from the wing into the buffer cavity, with the first and second protuberances being axially spaced from each other.

19 Claims, 4 Drawing Sheets

(56) References Cited

U.S. PATENT DOCUMENTS

| | | | | |
|---|---|---|---|---|
| 2009/0280011 | A1* | 11/2009 | Tibbott | F01D 5/081 416/95 |
| 2010/0074733 | A1 | 3/2010 | Little | |
| 2012/0251291 | A1 | 10/2012 | Ledezma et al. | |
| 2013/0051992 | A1 | 2/2013 | Diakunchak | |
| 2013/0200571 | A1 | 8/2013 | Mutou et al. | |
| 2014/0193243 | A1* | 7/2014 | Nallam | F01D 25/24 415/170.1 |

OTHER PUBLICATIONS

First Office Action and Search issued in connection with corresponding CN Application No. 201710073805.2 dated Jun. 22, 2018.

* cited by examiner

GAS TURBINE ENGINE WITH A RIM SEAL BETWEEN THE ROTOR AND STATOR

BACKGROUND OF THE INVENTION

Turbine engines, and particularly gas or combustion turbine engines, are rotary engines that extract energy from a flow of combusted gases passing through a fan with a plurality of blades, then into the engine through a series of compressor stages, which include pairs of rotating blades and stationary vanes, through a combustor, and then through a series of turbine stages, also consisting of rotating blades and stationary vanes.

In operation, turbine engines operate at increasingly hotter temperatures as the gasses flow from the compressor stages to the turbine stages. Various cooling circuits for the components exhaust to the main flowpath and must be provided with cooling air at sufficient pressure to prevent ingestion of the hot gases therein during operation.

For example, seals are provided between the stationary turbine nozzles and the rotating turbine blades to prevent ingestion or backflow of the hot gases into the cooling circuits. Improving the ability of these seals to prevent ingestion or backflow increases engine performance and efficiency.

BRIEF DESCRIPTION OF THE INVENTION

In one aspect, embodiments relate to a gas turbine engine comprising a rotor having at least one disk with circumferentially spaced blades, a stator having at least one ring with circumferentially spaced vanes, with the rings being adjacent the disk, a recess formed in one of the disk and ring to define a buffer cavity, a wing extending into the recess from the other of the disk and ring and defining a labyrinth fluid path through the buffer cavity. At least one set of protuberances including a recess protuberance extend from the recess into the buffer cavity and a wing protuberance extends from the wing into the buffer cavity.

In another aspect, embodiments relate to a rim seal between a rotor and a stator of a gas turbine engine comprising a recess formed in one of the rotor and stator to define a buffer cavity, a wing extending from the other of the rotor and stator into the recess to define a labyrinth fluid path through the buffer cavity, and at least one set of protuberances including a recess protuberance extending from the recess into the buffer cavity and a wing protuberance extending from the wing into the buffer cavity.

In yet another aspect, embodiments relate to a rim seal for gas turbine engine comprising a wing extending into a buffer cavity with at least one set of protuberances including a first protuberance extending into the buffer cavity and a second protuberance extending from the wing into the buffer cavity, with the first and second protuberances being axially spaced from each other.

DESCRIPTION OF EMBODIMENTS OF THE INVENTION

The described embodiments of the present invention are directed to a rim seal between a rotor and stator portion of a turbine section in a gas turbine engine. For purposes of illustration, the present invention will be described with respect to the turbine for an aircraft gas turbine engine. It will be understood, however, that the invention is not so limited and may have general applicability to engine sections beyond the turbine and to non-aircraft applications, such as other mobile applications and non-mobile industrial, commercial, and residential applications.

Figure 1:
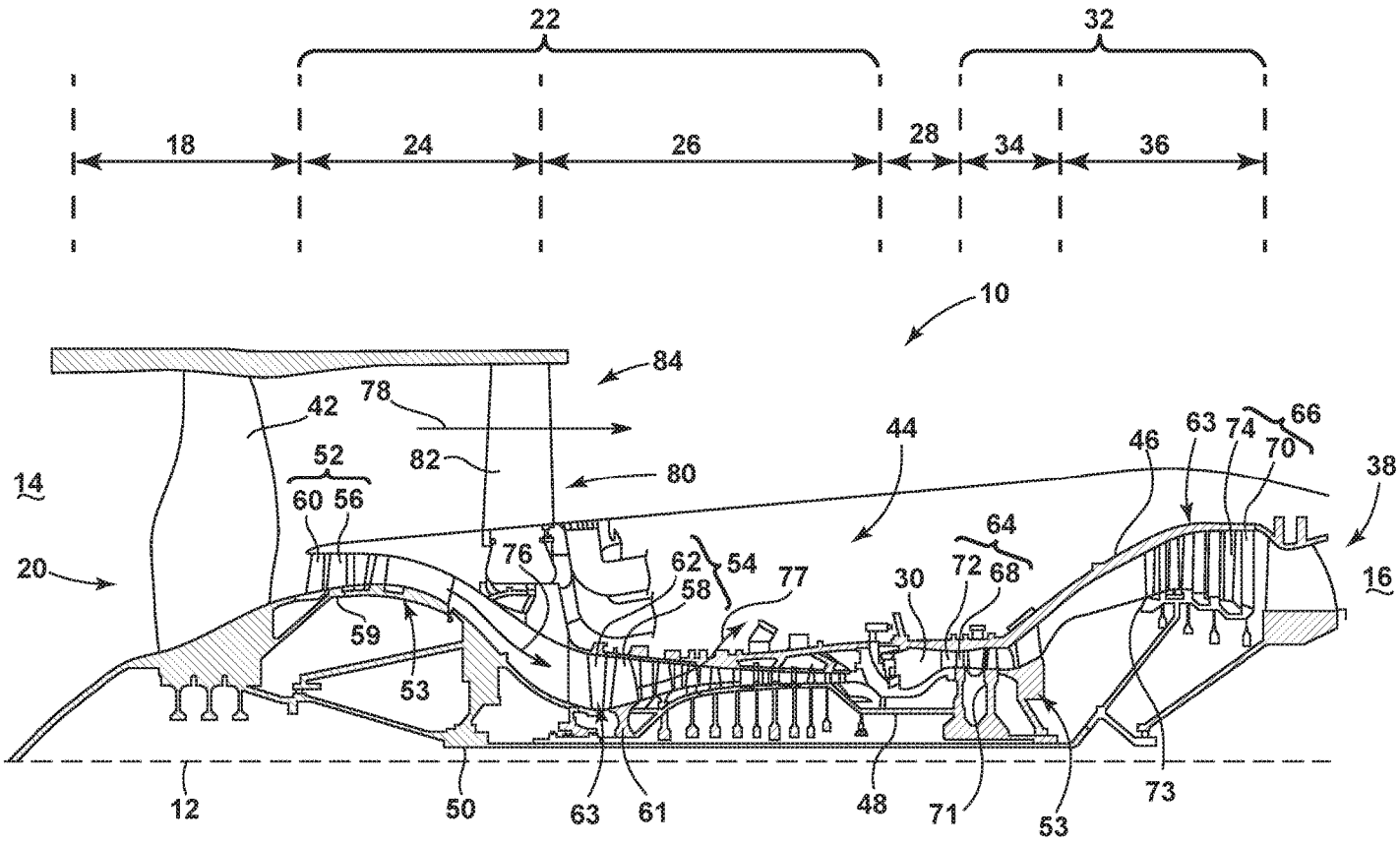
FIG. 1 is a schematic cross-sectional diagram of a gas turbine engine for an aircraft.

FIG. 1 is a schematic cross-sectional diagram of a gas turbine engine 10 for an aircraft. The engine 10 has a generally longitudinally extending axis or centerline 12 extending forward 14 to aft 16. The engine 10 includes, in downstream serial flow relationship, a fan section 18 including a fan 20, a compressor section 22 including a booster or low pressure (LP) compressor 24 and a high pressure (HP) compressor 26, a combustion section 28 including a combustor 30, a turbine section 32 including a HP turbine 34, and a LP turbine 36, and an exhaust section 38.

The fan section 18 includes a fan casing 40 surrounding the fan 20. The fan 20 includes a plurality of fan blades 42 disposed radially about the centerline 12. The HP compressor 26, the combustor 30, and the HP turbine 34 form a core 44 of the engine 10, which generates combustion gases. The core 44 is surrounded by core casing 46, which can be coupled with the fan casing 40.

A HP shaft or spool 48 disposed coaxially about the centerline 12 of the engine 10 drivingly connects the HP turbine 34 to the HP compressor 26. A LP shaft or spool 50, which is disposed coaxially about the centerline 12 of the engine 10 within the larger diameter annular HP spool 48, drivingly connects the LP turbine 36 to the LP compressor 24 and fan 20.

The LP compressor 24 and the HP compressor 26 respectively include a plurality of compressor stages 52, 54, in which a set of compressor blades 56, 58 rotate relative to a corresponding set of static compressor vanes 60, 62 (also called a nozzle) to compress or pressurize the stream of fluid passing through the stage. In a single compressor stage 52, 54, multiple compressor blades 56, 58 can be provided in a ring and can extend radially outwardly relative to the centerline 12, from a blade platform to a blade tip, while the corresponding static compressor vanes 60, 62 are positioned upstream of and adjacent to the rotating blades 56, 58. It is noted that the number of blades, vanes, and compressor stages shown in FIG. 1 were selected for illustrative purposes only, and that other numbers are possible.

The blades 56, 58 for a stage of the compressor can be mounted to a disk 59, which is mounted to the corresponding one of the HP and LP spools 48, 50, with each stage having its own disk 59, 61. The vanes 60, 62 for a stage of the compressor can be mounted to the core casing 46 in a circumferential arrangement.

The HP turbine 34 and the LP turbine 36 respectively include a plurality of turbine stages 64, 66, in which a set of turbine blades 68, 70 are rotated relative to a corresponding set of static turbine vanes 72, 74 (also called a nozzle) to extract energy from the stream of fluid passing through the stage. In a single turbine stage 64, 66, multiple turbine vanes 72, 74 can be provided in a ring and can extend radially outwardly relative to the centerline 12, while the corresponding rotating blades 68, 70 are positioned downstream of and adjacent to the static turbine vanes 72, 74 and can also extend radially outwardly relative to the centerline 12, from a blade platform to a blade tip. It is noted that the number of blades, vanes, and turbine stages shown in FIG. 1 were selected for illustrative purposes only, and that other numbers are possible.

The blades 68, 70 for a stage of the turbine can be mounted to a disk 71, which is mounted to the corresponding one of the HP and LP spools 48, 50, with each stage having its own disk 71, 73. The vanes 72, 74 for a stage of the compressor can be mounted to the core casing 46 in a circumferential arrangement.

The portions of the engine 10 mounted to and rotating with either or both of the spools 48, 50 are also referred to individually or collectively as a rotor 53. The stationary portions of the engine 10 including portions mounted to the core casing 46 are also referred to individually or collectively as a stator 63.

In operation, the airflow exiting the fan section 18 is split such that a portion of the airflow is channeled into the LP compressor 24, which then supplies pressurized ambient air 76 to the HP compressor 26, which further pressurizes the ambient air. The pressurized air 76 from the HP compressor 26 is mixed with fuel in the combustor 30 and ignited, thereby generating combustion gases. Some work is extracted from these gases by the HP turbine 34, which drives the HP compressor 26. The combustion gases are discharged into the LP turbine 36, which extracts additional work to drive the LP compressor 24, and the exhaust gas is ultimately discharged from the engine 10 via the exhaust section 38. The driving of the LP turbine 36 drives the LP spool 50 to rotate the fan 20 and the LP compressor 24.

A remaining portion of the airflow 78 bypasses the LP compressor 24 and engine core 44 and exits the engine assembly 10 through a stationary vane row, and more particularly an outlet guide vane assembly 80, comprising a plurality of airfoil guide vanes 82, at the fan exhaust side 84. More specifically, a circumferential row of radially extending airfoil guide vanes 82 are utilized adjacent the fan section 18 to exert some directional control of the airflow 78.

Some of the ambient air supplied by the fan 20 can bypass the engine core 44 and be used for cooling of portions, especially hot portions, of the engine 10, and/or used to cool or power other aspects of the aircraft. In the context of a turbine engine, the hot portions of the engine are normally the combustor 30 and components downstream of the combustor 30, especially the turbine section 32, with the HP turbine 34 being the hottest portion as it is directly downstream of the combustion section 28. Other sources of cooling fluid can be, but is not limited to, fluid discharged from the LP compressor 24 or the HP compressor 26. This fluid can be bleed air 77 which can include air drawn from the LP or HP compressors 24, 26 that bypasses the combustor 30 as cooling sources for the turbine section 32. This is a common engine configuration, not meant to be limiting.

Figure 2:
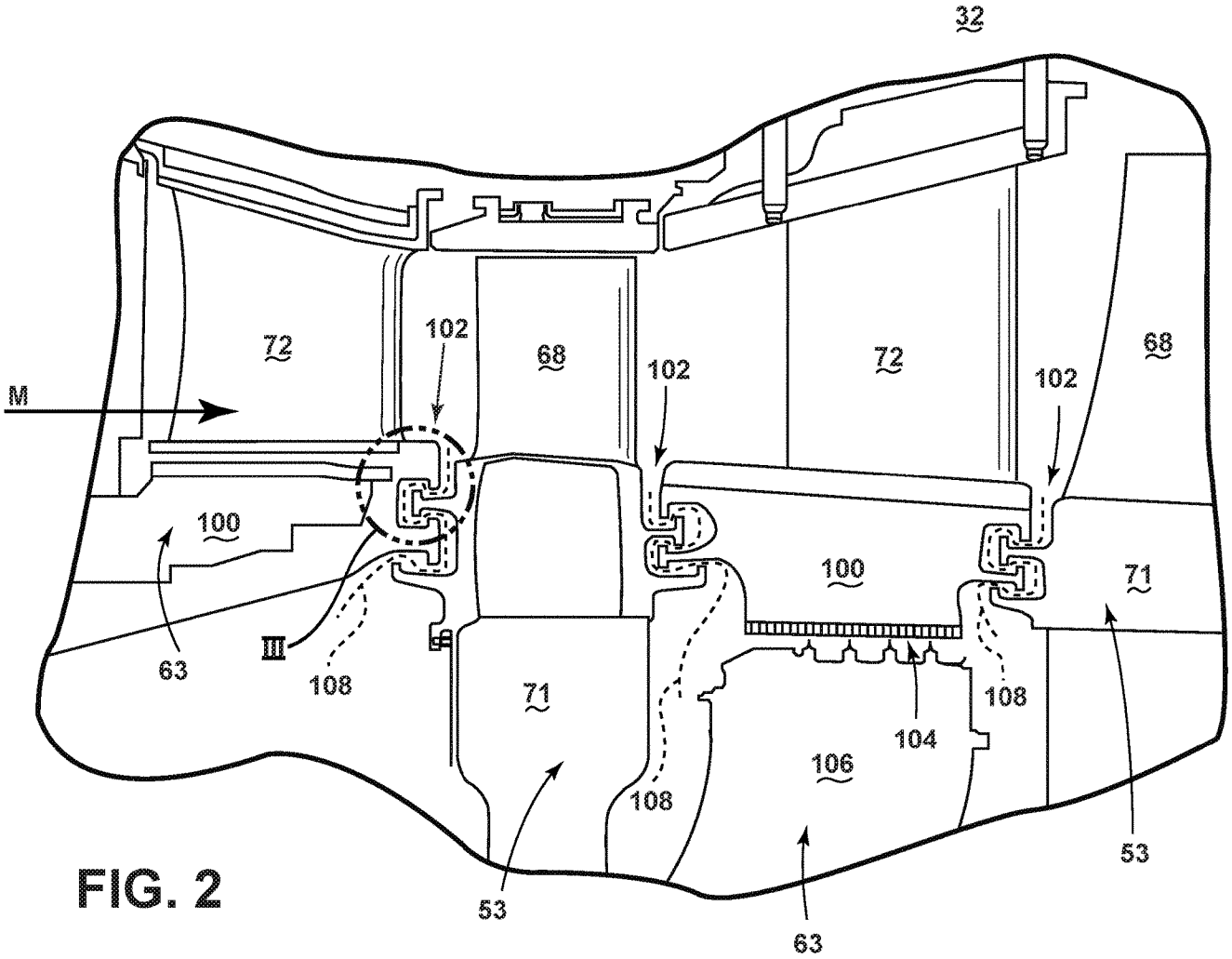
FIG. 2 is a sectional view of a turbine section of the gas turbine engine of FIG. 1.

FIG. 2 depicts a portion of the turbine section 32 including the stator 63 and the rotor 53. While the description herein is written with respect to a turbine, it should be appreciated that the concepts disclosed herein can have equal application to a compressor section. The rotor 53 includes at least one disk 71 with circumferentially spaced blades 68. The rotor 53 can rotate about the centerline 12, such that the blades 68 rotate radially around the centerline 12.

The stator 63 includes at least one ring 100 with circumferentially spaced vanes 72. The ring 100 is adjacent the disk 71 and form a rim seal 102 between the rotor 53 and stator 63. A radial seal 104 can mount to a stator disk 106 adjacent to the ring 100. Each vane 72 is radially spaced apart from each other to at least partially define a path for a mainstream airflow M.

The mainstream airflow M moves in a forward 14 to aft 16 direction, driven by the blades 68. The rim seal 102 and radial seal 104 can have leak paths through which some airflow from the mainstream airflow M can leak in a direction opposite of the mainstream airflow M causing unwanted heating of portions of the rotor 53 and stator 63. A labyrinth fluid path 108 extends between the ring 100 and the disk 71 and is used to counteract the heating of these portions.

Figure 3:
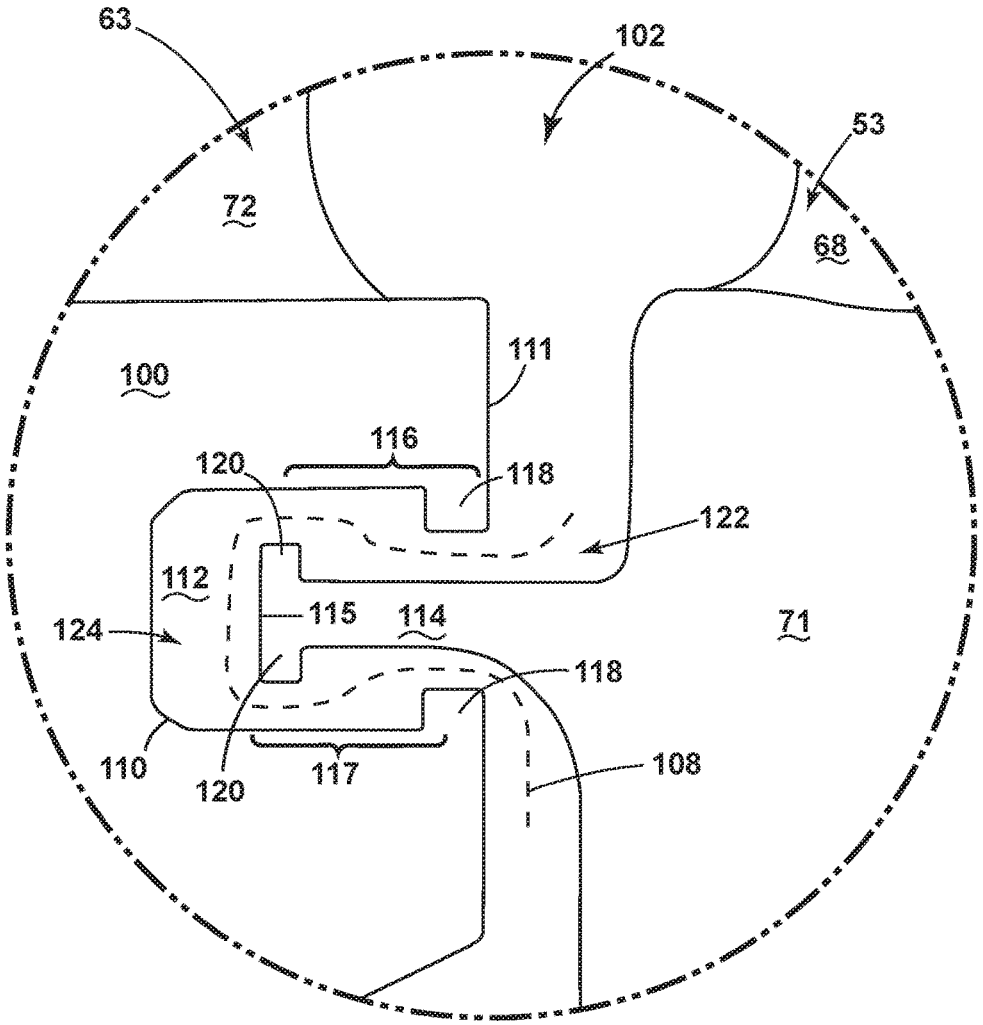
FIG. 3 is an enlarged view of a section of FIG. 2 illustrating a rotor wing disposed in a channel of an upstream stator.

Turning to FIG. 3 an enlarged view of a portion III more clearly details the labyrinth fluid path 108. A recess 110, having a terminal end 111, can be formed in one of the disk 71 and ring 100 to define a buffer cavity 112. A wing 114, having a terminal end 115, can be formed in the other of the disk 71 and ring 100. In an exemplary embodiment, the recess 110 is formed in the ring 100 and the wing 114 extends from the disk 71 together defining the labyrinth fluid path 108.

At least one set of protuberances 116 extends radially into the buffer cavity 112. Each set 116 comprises a first, or recess, protuberance 118 extending from the recess 110 and a second, or wing, protuberance 120 extending from the wing 114. The protuberance 118, 120 radial extent is less than the radial tolerances between the disk 71 and the ring 100 so as to leave appropriate clearance between the wing 114 and recess 110 surfaces. Each protuberance 118, 120 is axially spaced from each other with a spacing that is greater than the axial tolerances between the disk 71 and the ring 100. The radial and axial tolerances are determined in order to maintain an appropriate clearance to account for radial and axial thermal expansion of engine parts due to variations in temperature.

In an exemplary embodiment illustrated in FIG. 3, the wing 114 divides the buffer cavity 112 into at least two portions 122, 124. The set of protuberances 116 can be found in the first portion 122 while a second set of protuberances 117 can be found in the second portion 124. Each protuberance 118, 120 is located at the terminal end 111, 115 of the recess 110 and the wing 114 where the recess protuberance 118 is axially forward of the wing protuberance 120. Together the wing protuberances 120 create a T-shape at the terminal end 115 of the wing 114.

Figure 4:
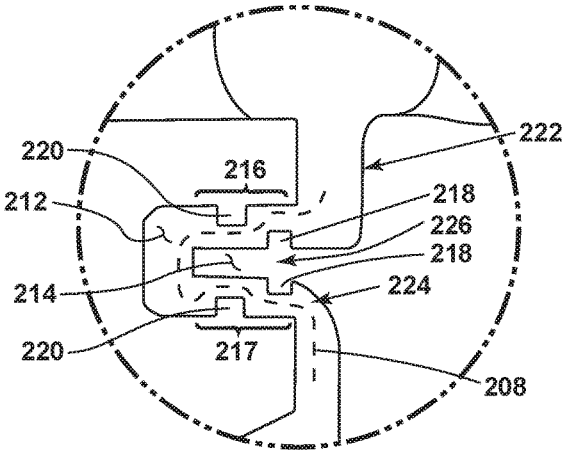
FIG. 4 is a second embodiment of the rotor wing of FIG. 3.
Figure 5:
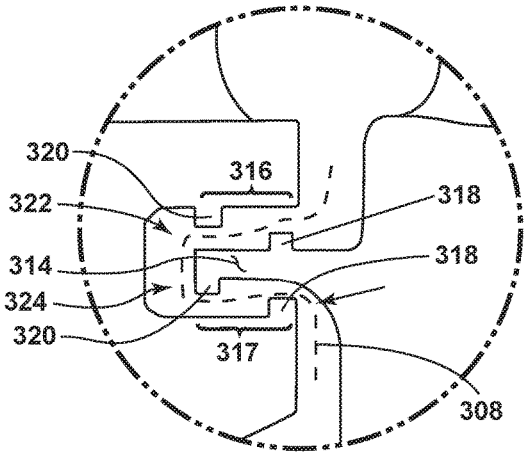
FIG. 5 is a third embodiment of the rotor wing of FIG. 3.
Figure 6:
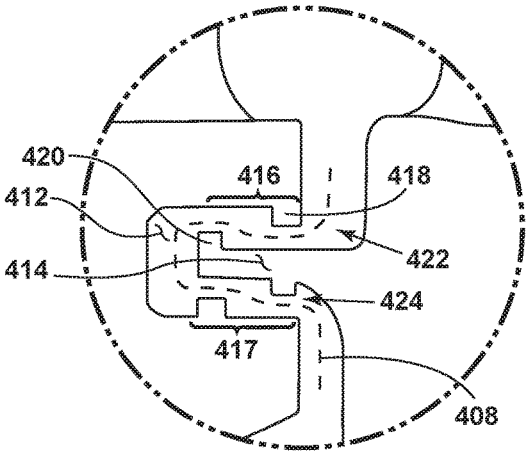
FIG. 6 is a fourth embodiment of the rotor wing of FIG. 3.

Other embodiments of a rim seal with sets of protuberances are contemplated in FIGS. 4, 5, and 6. The second, third, and fourth embodiments are similar to the first embodiment, therefore, like parts will be identified with like numerals increasing by 100, 200, 300 respectively, with it being understood that the description of the like parts of the first embodiment applies to the additional embodiments, unless otherwise noted.

FIG. 4 illustrates wing protuberances 218 axially forward of recess protuberances 220 where the wing protuberance 218 extends from a mid-span portion 226 of a wing 214 radially above or below the terminal ends 211 of the recess 110.

In another exemplary embodiment shown in FIG. 5, unlike in the first two exemplary embodiments, recess and wing protuberances 318, 320 do not form a mirror image of each other. Instead they are staggered in that the first set of protuberances 316 includes the wing protuberance 318 axially forward of the recess protuberance 320, and the second set 317 includes the recess protuberance 320 axially forward of the wing protuberance 318. The second set 317 includes both protuberances 318, 320 at the corresponding terminal ends 311, 315.

A fourth embodiment contemplated in FIG. 6 is similar to the third embodiment, only now a first set of protuberances 416 includes a recess protuberance 418 axially forward of the wing protuberance 420. The first set 416 includes both protuberances 418, 420 at the corresponding terminal ends 411, 415. The second set of protuberances 417 includes the wing protuberance 420 axially forward of the recess protuberance 418. It should be appreciated that other arrangements of sets of protuberances are possible and the exemplary embodiments are for illustration purposes only.

Benefits to including at least one set of protuberances in the rim seal include resisting hot gas ingestion from the mainstream flow. Protuberances create additional cavities for vortex interruption of ingestion flow and the positioning of sets of protuberances can be optimized for engines where fine control of radial and axial transient clearances is optimized throughout engine operation.

The configurations described herein enable sealing at multiple operating points. These configurations prevent hot gas from ingesting past the buffer cavity where it can be detrimental to portions of the rotor and stator. Preventing hot gas from ingesting also allows for less purge flow and therefore improved specific fuel consumption (SFC).

It should be appreciated that application of the disclosed design is not limited to turbine engines with fan and booster sections, but is applicable to turbojets and turbo engines as well.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A gas turbine engine comprising:

a rotor having at least one disk with circumferentially spaced blades;

a stator having at least one ring with circumferentially spaced vanes, with the ring being adjacent the disk;

a recess formed in one of the disk and ring to define a buffer cavity having a terminal end;

a wing extending into the recess from the other of the disk and ring and defining a labyrinth fluid path through the buffer cavity;

a first recess protuberance axially spaced from the terminal end and defining a circumferential ridge having axially spaced opposing sides, extending radially from the recess into the buffer cavity and further defining at least a portion of the labyrinth path on each of the opposing sides; and at least two wing protuberances, each having substantially the same cross-section as the other, extending from opposing sides of the wing into the buffer cavity in opposite radial directions;

wherein at least one of the at least two wing protuberance is axially spaced from the first recess protuberance and the radial extent of the first recess protuberance and the at least two wing protuberances is less than radial tolerances between the disk and the ring.

2. The gas turbine engine of claim 1 wherein the wing divides the buffer cavity into at least two portions, a first portion and a second portion, and the first recess protuberance is in the first portion or the second portion.

3. The gas turbine engine of claim 2 wherein one of the at least two wing protuberances is in the first portion and one is located in the second portion.

4. The gas turbine engine of claim 1 further comprising a second recess protuberance axially forward of one of the at least two wing protuberances.

5. The gas turbine engine of claim 1 wherein the amount of axial spacing between the at least one wing protuberance and the first recess protuberance is greater than axial tolerances between the disk and ring.

6. The gas turbine engine of claim 4 wherein the second recess protuberance and at least one of the at least two wing protuberances are located at the terminal end of the recess and a terminal end of the wing respectively.

7. The gas turbine engine of claim 1 wherein the recess is located within the ring and the wing extends from the disk.

8. A rim seal between a rotor and a stator of a gas turbine engine comprising:

a recess formed in one of the rotor and stator to define a buffer cavity having a terminal end;

a wing extending from the other of the rotor and stator into the recess to define a labyrinth fluid path through the buffer cavity; and at least one recess protuberance axially spaced from the terminal end and defining a circumferential ridge having axially spaced opposing sides, extending radially from the recess into the buffer cavity and further defining at least a portion of the labyrinth path on each of the opposing sides; and at least two wing protuberances, each having substantially the same cross-section as the other, extending from opposing sides of the wing into the buffer cavity in opposite radial directions;

wherein at least one of the at least two wing protuberance is axially spaced from the at least one recess protuberance and the radial extent of the at least one recess protuberance and the at least two wing protuberances is less than radial tolerances between the rotor and the stator.

9. The rim seal of claim 8 wherein the wing divides the buffer cavity into at least two portions, a first portion and a second portion, and the at least one recess protuberance and at least one of the at least two wing protuberances are in the first portion or the second portion.

10. The rim seal of claim 9 wherein one of the at least two wing protuberances is located in the first portion and one is located in the second portion.

11. The rim seal of claim 10 wherein the recess protuberance is axially forward of the wing protuberance.

12. The rim seal of claim 10 wherein the amount of axial spacing between the at least one wing protuberance and the at least one recess protuberance is greater than axial tolerances between the rotor and stator.

13. The rim seal of claim 10 further comprising a second recess protuberance located at the terminal end of the recess and at least one of the at least two wing protuberances is located at the terminal end of the wing.

14. The rim seal of claim 10 wherein the recess is located within the in the stator and the wing extends from the rotor.

15. A rim seal for gas turbine engine comprising a wing extending into a buffer cavity having a terminal end with a first protuberance axially spaced from the terminal end and extending from one of a rotor or stator into the buffer cavity, a second protuberance extending from the wing into the buffer cavity in a first direction, a third protuberance having substantially the same cross-sectional area as the second protuberance and extending from an opposing side of the wing in a second direction opposite the first direction, with the first and second protuberances being axially spaced from each other, wherein the first protuberance, second protuberance, and third protuberances are circumferential ridges having axially spaced opposing sides defining at least a portion of a labyrinth path on each of the opposing sides and a radial extent of each of the first, second, and third protuberances is less than radial tolerances between the rotor and the stator.

16. The rim seal of claim 15 wherein the wing divides the buffer cavity into at least two portions and the first and second protuberance are in the same portion.

17. The rim seal of claim 16 wherein at first protuberance is located in the first portion and the second protuberance located in the second portion.

18. The rim seal of claim 15 wherein the first protuberance is axially forward of the second protuberance.

19. The rim seal of claim 15 wherein the axial spacing between the first and second protuberances is greater than axial tolerances between the rotor and stator.

* * * * *